US009175532B2

(12) United States Patent
Nikiforuk et al.

(10) Patent No.: US 9,175,532 B2
(45) Date of Patent: Nov. 3, 2015

(54) DOWNHOLE TOOL HYDRAULIC RETRIEVER

(71) Applicant: Schlumberger Technology Corporation, Sugar Land, TX (US)

(72) Inventors: Kevin J. Nikiforuk, Houston, TX (US); Daniel Howard Milmine, Sherwood Park (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 371 days.

(21) Appl. No.: 13/729,628

(22) Filed: Dec. 28, 2012

(65) Prior Publication Data

US 2013/0186628 A1 Jul. 25, 2013

Related U.S. Application Data

(60) Provisional application No. 61/580,955, filed on Dec. 28, 2011.

(51) Int. Cl.

| | |
|---|---|
| ***E21B 23/00*** | (2006.01) |
| ***E21B 23/08*** | (2006.01) |
| ***E21B 4/18*** | (2006.01) |
| ***E21B 7/20*** | (2006.01) |

(52) U.S. Cl.
CPC . *E21B 23/00* (2013.01); *E21B 4/18* (2013.01); *E21B 7/20* (2013.01); *E21B 23/08* (2013.01)

(58) Field of Classification Search
CPC ..... E21B 23/00; E21B 23/01; E21B 33/12; E21B 33/128; E21B 33/1285; E21B 7/20; E21B 4/18
See application file for complete search history.

(56) References Cited

U.S. PATENT DOCUMENTS

| | | | | |
|---|---|---|---|---|
| 5,228,507 | A | 7/1993 | Obrejanu et al. | |
| 6,978,841 | B2 | 12/2005 | Hoffman et al. | |
| 2002/0157867 | A1 * | 10/2002 | Moore | 175/20 |
| 2007/0068677 | A1 | 3/2007 | Angman et al. | |
| 2009/0288886 | A1 | 11/2009 | Eriksen et al. | |
| 2010/0200236 | A1 | 8/2010 | Warren et al. | |
| 2010/0282463 | A1 * | 11/2010 | Boyle | 166/277 |

OTHER PUBLICATIONS

Notification of Transmittal of the International Search Report and the Written Opinion issued Apr. 23, 2013 in corresponding International application No. PCT/US2012/071998 (11 pages).

* cited by examiner

*Primary Examiner* — Yong-Suk (Philip) Ro
(74) *Attorney, Agent, or Firm* — Osha Liang LLP

(57) ABSTRACT

A downhole tool hydraulic retriever is provided that includes a stroking unit comprising a hydraulic cylinder, a piston body at least partially disposed within the hydraulic cylinder, and a piston rod extending from the piston body. The downhole tool hydraulic retriever also includes first and second packer cup assemblies configured to translate axially with respect to each other. In addition, the downhole tool hydraulic retriever includes a pressure intensification module comprising sequencing valves and hydraulic distribution lines configured to divert pressure to the first packer cup assembly when the piston body is at a beginning of a stroke within the hydraulic cylinder, and to divert pressure to the second packer cup assembly when the piston body is at an end of the stroke within the hydraulic cylinder.

20 Claims, 4 Drawing Sheets

DOWNHOLE TOOL HYDRAULIC RETRIEVER

CROSS-REFERENCE TO RELATED APPLICATION

This application, pursuant to 35 U.S.C. §119(e), claims priority to U.S. Provisional Application Ser. No. 61/580,955, filed Dec. 28, 2011, which is herein incorporated by reference in its entirety.

FIELD OF THE DISCLOSURE

The present disclosure relates generally to the field of well drilling operations. More specifically, embodiments of the present disclosure relate to a downhole tool hydraulic retriever.

BACKGROUND

In conventional oil and gas operations, a well is typically drilled to a desired depth with a drill string, which includes drill pipe and a drilling bottom hole assembly (BHA). Once the desired depth is reached, the drill string is removed from the hole and casing is run into the vacant hole. In some conventional operations, the casing may be installed as part of the drilling process. A technique that involves running casing at the same time the well is being drilled may be referred to as "casing-while-drilling."

At some point during drilling operations, the drilling BHA is retrieved from the wellbore. Conventional techniques for retrieving the drilling BHA include attaching the drilling BHA to a drill string and pulling the drill string out of the wellbore. Such retrieval techniques require surface equipment, such as wireline, drill pipe, and so forth. It is now recognized that improved techniques and equipment for retrieving drilling BHAs (and other downhole tools) are desirable.

BRIEF DESCRIPTION

In accordance with one aspect of the invention, a downhole tool hydraulic retriever is provided. The downhole tool hydraulic retriever includes a stroking unit, which includes a hydraulic cylinder, a piston body at least partially disposed within the hydraulic cylinder, and a piston rod extending from the piston body. The piston rod includes an inner bore for enabling flow of drilling mud from an upper end of the downhole tool hydraulic retriever to a lower end of the downhole tool hydraulic retriever. The downhole tool hydraulic retriever also includes first and second pipe gripping mechanisms configured to translate axially with respect to each other. In addition, the downhole tool hydraulic retriever includes a pressure intensification module comprising sequencing valves and hydraulic distribution lines. The downhole tool hydraulic retriever also includes a connection mechanism configured to connect to a bottom hole assembly. The connection mechanism is configured to block the flow of drilling mud through the inner bore of the piston rod and to direct the flow of drilling mud through the pressure intensification module when the connection mechanism is connected to the bottom hole assembly. The pressure intensification module is configured to alternatingly direct pressure associated with the flow of drilling mud between the first and second pipe gripping mechanisms through the sequencing valves and hydraulic distribution lines of the pressure intensification module, such that the first and second pipe gripping mechanisms alternatingly apply an outward radial force.

In accordance with another aspect of the invention, a downhole tool hydraulic retriever is provided. The downhole tool hydraulic retriever includes a stroking unit comprising a hydraulic cylinder, a piston body at least partially disposed within the hydraulic cylinder, and a piston rod extending from the piston body. The downhole tool hydraulic retriever also includes first and second pipe gripping mechanisms configured to translate axially with respect to each other. In addition, the downhole tool hydraulic retriever includes a pressure intensification module comprising sequencing valves and hydraulic distribution lines configured to divert pressure to the first pipe gripping mechanism when the piston body is at a beginning of a stroke within the hydraulic cylinder, and to divert pressure to the second pipe gripping mechanism when the piston body is at an end of the stroke within the hydraulic cylinder.

In accordance with another aspect of the invention, a method includes pumping a drilling mud and a downhole tool hydraulic retriever down through casing, wherein the downhole tool hydraulic retriever is not connected to any other equipment. The method also includes connecting the downhole tool hydraulic retriever to downhole equipment. The method further includes using pressure of the drilling mud to cause the downhole tool hydraulic retriever and the connected downhole equipment to travel upward through the casing against the flow of the drilling mud.

BRIEF DESCRIPTION OF DRAWINGS

These and other features, aspects, and advantages of embodiments herein will become better understood when the following detailed description is read with reference to the accompanying drawings, in which like characters represent like parts throughout the drawings.

DETAILED DESCRIPTION

The present disclosure relates generally to methods and equipment for retrieving drilling BHAs (or other downhole tools) from wellbores. More specifically, embodiments of the present disclosure are directed to a downhole tool hydraulic retriever capable of utilizing the pressure of drilling mud that is used to pump the downhole tool hydraulic retriever down through the wellbore as the motive force for causing the downhole tool hydraulic retriever to self-extract by maneuvering itself up through the wellbore (i.e., against the flow of drilling mud) after being connected to the drilling BHA (or other downhole tool). More specifically, the downhole tool hydraulic retriever described herein includes a pressure intensification module that is configured to apply (and release) pressure to first and second packer cup assemblies in an alternating manner, thereby causing the first and second packer cup assemblies to grip and inner wall of the wellbore in an alternating manner. At the same time, the pressure intensification module also applies (and releases) pressure against a piston within a hydraulic cylinder, wherein the reciprocating motion of the piston within the hydraulic cylinder provides the motive force for causing the downhole tool hydraulic retriever to move axially upward through the wellbore. As such, the downhole tool hydraulic retriever is configured to be pumped down by itself (i.e., not being tethered or otherwise attached to any other equipment) with the flow of the drilling mud, and configured to travel hack up through the wellbore against the flow of drilling mud once the downhole tool hydraulic retriever has attached to the drilling BHA (or other downhole tool) being retrieved by the downhole tool hydraulic retriever.

Figure 1:
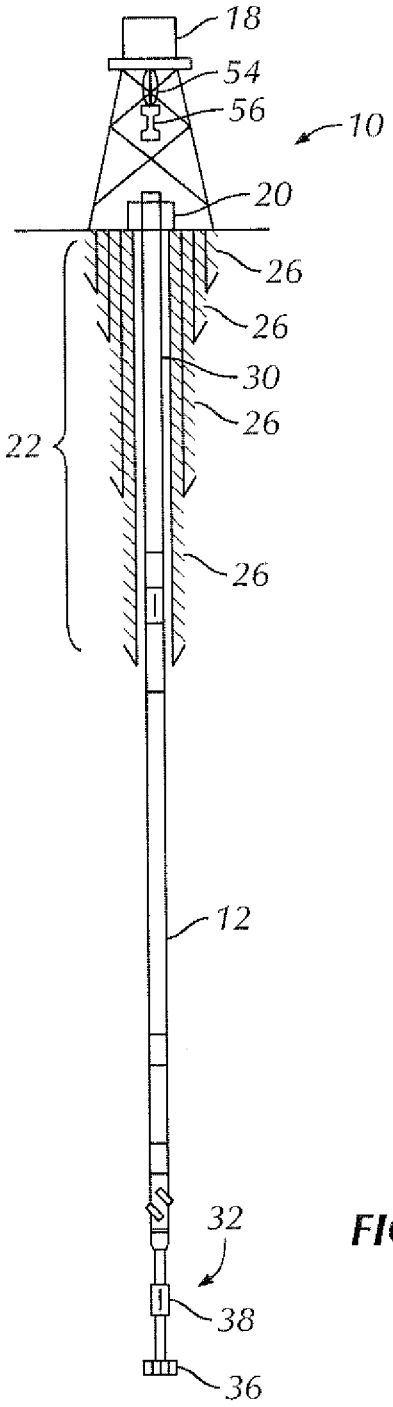
FIG. 1 is a schematic representation of a well being drilled in accordance with present techniques.

Turning to the figures, FIG. 1 is a schematic representation of a well 10 that is being drilled using a casing-while-drilling technique, wherein a casing string 12 is disposed within the well 10 in accordance with present techniques. In other embodiments, different drilling techniques may be employed. The well 10 includes a derrick 18, wellhead equipment 20, and several levels of casing 22 (e.g., conductor pipe, surface pipe, intermediate string, and so forth). The casing 22 is prepared to be cemented into the well 10 with cement 26. Further, as illustrated in FIG. 1, when the casing string 12 is in place, the drilling bottom hole assembly 32 (which may include a drill bit 36 and under reamer 38) is ready to be removed from the well 10.

Once a desired depth is reached, the casing string 12 may be hung or set down to facilitate detachment of the drilling BHA 32. As illustrated in FIG. 1, the casing string 12 may be hung from wellhead equipment 20 such as slips, and the drilling BHA 32 may be detached from the casing string 12 and retrieved from the well 10. As described above, conventional techniques include pulling the drilling BHA 32 from the well 10 with the drill string (not shown). However, in comparison to present embodiments, using the drill string (not shown) to retrieve the drilling BHA 32 generally requires additional surface equipment, such as wireline, drill pipe, and so forth. As such, the embodiments described herein include a downhole tool hydraulic retriever 56 that may be pumped down through the casing string 12 with drilling mud as a single unit that is free (i.e., not connected to drill pipe, coiled tubing, or any other equipment).

As described in greater detail below, once the downhole tool hydraulic retriever 56 reaches the drilling BHA 32, the downhole tool hydraulic retriever 56 attaches to the drilling BHA 32 and then self-extracts itself and the drilling BHA 32 back up through the casing string 12 (i.e., against the flow of drilling mud being pumped down through the casing string 12). More specifically, the downhole tool hydraulic retriever 56 uses the hydraulic pressure of the drilling mud to cause an upper and lower packer cup assembly to alternatingly grip an inner wall of the casing string 12 by, for example, applying an outward radial force against the inner wall of the casing string 12. While one of the upper and lower packer cup assemblies grips the inner wall of the casing string 12, the hydraulic pressure of the drilling mud also causes the other packer cup assembly to move upward through the casing string 12 (i.e., against the flow of drilling mud) using a hydraulic cylinder and associated piston, and a pressure intensification module that includes a series of sequencing valves and distribution lines to alternatingly divert pressure from the drilling mud between the upper and lower packer cup assemblies, as described in greater detail below.

Figure 2A:
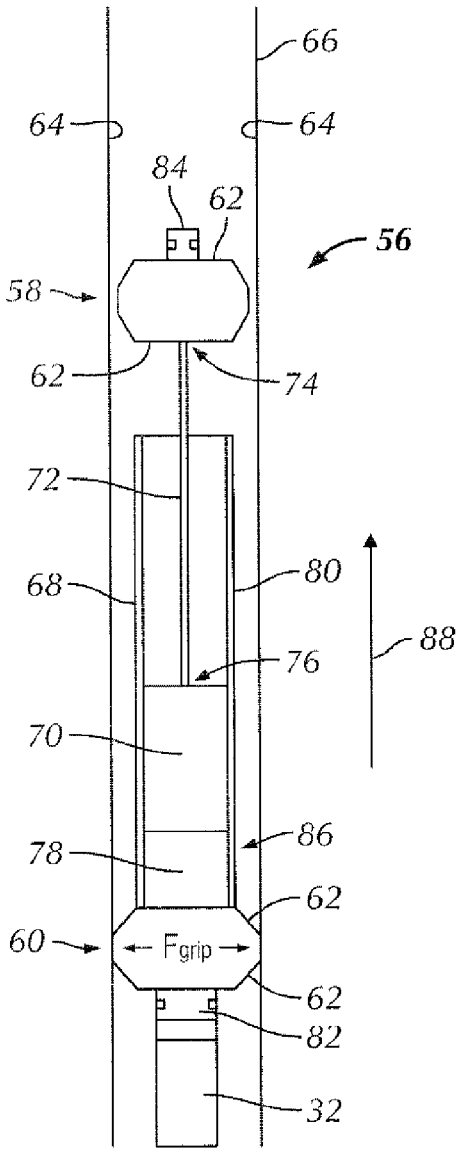
FIG. 2A is a schematic diagram of a downhole tool hydraulic retriever with drilling mud pressure being diverted to a lower packer cup assembly in accordance with present techniques.
Figure 2B:
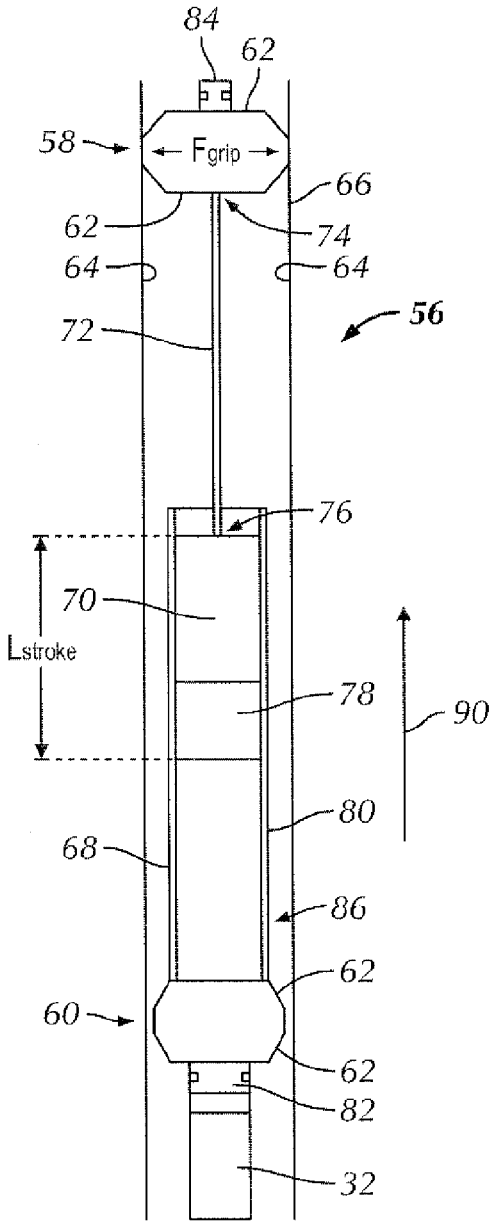
FIG. 2B is a schematic diagram of a downhole tool hydraulic retriever with drilling mud pressure being diverted to an upper packer cup assembly in accordance with present techniques.

FIGS. 2A and 2B are schematic diagrams of the downhole tool hydraulic retriever 56 in accordance with present techniques. Specifically, FIG. 2A illustrates the downhole tool hydraulic retriever 56 in a first operational mode (e.g., a compressed configuration) and FIG. 2B illustrates the downhole tool hydraulic retriever 56 in a second operational mode (e.g., an expanded configuration). As illustrated, the downhole tool hydraulic retriever 56 includes an upper packer cup assembly 58 and a lower packer cup assembly 60. Although illustrated in FIGS. 2A and 2B and described herein as being packer cup assemblies including face-to-face packer cups 62, in other embodiments, the packer cup assemblies 58, 60 may instead be replaced with any other gripping mechanisms suitable for gripping an inner wall 64 of a casing 66 (e.g., the casing string 12 of FIG. 1) within which the downhole tool hydraulic retriever 56 is disposed, and for supporting the weight of the drilling BHA 32 (or other downhole tool) being retrieved. For example, in other embodiments, the packer cup assemblies 58, 60 may instead be replaced by a set of one-way slips.

As illustrated in FIGS. 2A and 2B, the downhole tool hydraulic retriever 56 also includes a hydraulic cylinder 68, a piston 70 configured to translate axially through the hydraulic cylinder 68, and a piston rod 72 extending axially from the piston 70. In the illustrated embodiment, an upper axial end 74 of the piston rod 72 is attached to the upper packer cup assembly 58, and a lower axial end 76 of the piston rod 72 is attached to the piston 70. In addition, the downhole tool hydraulic retriever 56 includes a pressure intensification module 78 which, in the illustrated embodiment, is disposed adjacent the piston 70. Furthermore, the hydraulic cylinder 68, piston 70, and pressure intensification module 78 may all be disposed within a housing 80 of the downhole tool hydraulic retriever 56. In the illustrated embodiment, the housing 80 is attached to the lower packer cup assembly 60. The downhole tool hydraulic retriever 56 also includes a connector 82 (e.g., a drilling BHA connector) that is configured to attach to the drilling BHA 32 and/or other downhole tools. For example, in certain embodiments, the connector 82 may be a grapple jaw. In the illustrated embodiment, the connector 82 is disposed adjacent to the lower packer cup assembly 60. The downhole tool hydraulic retriever 56 also includes a landing catch/unloader 84 that is configured to attach to a CDS 54 (e.g., of the well 10 illustrated in FIG. 1). In the illustrated embodiment, the landing catch/unloader 84 is disposed adjacent to the upper packer cup assembly 58 (or slip assembly).

It should be noted that, in certain embodiments, the spatial relationships between the components of the downhole tool hydraulic retriever 56 may vary from those illustrated in FIGS. 2A and 2B. For example, as described in greater detail below, in certain embodiments, the packer cup assemblies 58, 60 may be located relatively close to each other either above or below many of the other components (e.g., the hydraulic cylinder 68, piston 70, pressure intensification module 78, and so forth) of the downhole tool hydraulic retriever 56, instead of being disposed on opposite axial sides of many of the other components (e.g., the hydraulic cylinder 68, piston 70, pressure intensification module 78, and so forth) of the downhole tool hydraulic retriever 56, as illustrated in FIGS. 2A and 2B.

As described above, in general, the downhole tool hydraulic retriever 56, without being coupled to any surface equipment, is pumped by itself down the wellbore along with drilling mud. Once the downhole tool hydraulic retriever 56 reaches the bottom of the wellbore and contacts the drilling BHA 32, the connector 82 attaches to the drilling BHA 32 and the downhole tool hydraulic retriever 56 becomes ready to retrieve the drilling BHA 32 from the wellbore. In addition, when the connector 82 attaches to the drilling BHA 32, a valve within the pressure intensification module 78 may be activated to block the flow of the drilling mud through the inner bore of the downhole tool hydraulic retriever 56, and to divert the drilling mud through sequencing valves and distribution lines associated with the pressure intensification module 78.

As also described in greater detail below, the sequencing valves and distribution lines of the pressure intensification module 78 are configured to divert pressure associated with the flow of drilling mud through the pressure intensification module 78 in an alternating manner between the upper and lower packer cup assemblies 58, 60. More specifically, in certain embodiments, whether the pressure associated with the flow of the drilling mud through the pressure intensification module 78 is diverted to the upper packer cup assembly 58 or the lower packer cup assembly 60 is dependent upon a stroke position of the piston 70 within the hydraulic cylinder 68. For example, as illustrated in FIG. 2A, when the piston 70 is at its lowest axial position within the hydraulic cylinder 68 (e.g., corresponding to a beginning of a stroke cycle), the pressure associated with the drilling mud may be diverted to the lower packer cup assembly 60.

This diverted pressure causes the lower packer cup assembly 60 to expand radially outward, thereby applying an outward radial (e.g., "gripping") force $F_{grip}$ against the inner wall 64 of the casing 66 within which the downhole tool hydraulic retriever 56 is disposed As such, the lower packer cup assembly 60 grips the inner wall 64 of the casing 66, thereby holding the lower packer cup assembly 60, housing 80, and hydraulic cylinder 68 relatively fixed at an axial location within the casing 66. However, the piston 70, piston rod 72, and upper packer cup assembly 58 remain relatively free to move in axial directions. It will be understood that, in certain embodiments where the pressure intensification module 78 is attached to tile piston 70, the pressure intensification module 78 will also remain relatively free to move in axial directions. However, in other embodiments, the pressure intensification module 78 may instead be fixed relative to the housing 80 and hydraulic cylinder 68.

At the same time the pressure associated with the flow of the drilling mud through the pressure intensification module 78 is diverted to the lower packer cup assembly 60 (i.e., when the piston 70 is at its lowest axial position) within the hydraulic cylinder 68 (e.g., corresponding to the beginning of a stroke cycle), the pressure intensification module 78 also diverts 'pressure associated with the drilling mud to a piston end 86 of the hydraulic cylinder 68. As such, the piston 70 (as well as the piston rod 72 and upper packer cup assembly 58) is forced axially upward (i.e., against the flow of drilling and being pumped down through the casing 66) with respect to the hydraulic cylinder 68 (as well as the housing 80 and the lower packer cup assembly 60), as illustrated by arrow 88.

When the piston 70 reaches its highest axial position within the hydraulic cylinder 68 (e.g., corresponding to an end of a stroke cycle), as illustrated in FIG. 2B, the pressure that is being diverted to the lower packer cup assembly 60 will be released from the lower packer cup assembly 60 and instead be diverted by the sequencing valves and hydraulic distribution lines of the pressure intensification module 78 to the upper packer cup assembly 58. This diversion of the pressure to the upper packer cup assembly 58 causes the upper packer cup assembly 58 to expand radially outward, thereby applying an outward radial (e.g., "gripping") force $F_{grip}$, against the inner wall 64 of the casing 66 within which the downhole tool hydraulic retriever 56 is disposed. At the same time, the lower packer cup assembly 60 relaxes radially due to the pressure being released by the pressure intensification module 78. As such, the upper packer cup assembly 58 now grips the inner wall 64 of the casing 66, thereby holding the piston 70, piston rod 72, and upper packer cup assembly 58 relatively fixed at an axial location within the casing 66. However, the lower packer cup assembly 60, housing 80, and hydraulic cylinder 68 become relatively free to move in axial directions.

At the same time the pressure associated with the flow of the drilling mud through the pressure intensification module 78 is diverted to the upper packer cup assembly 58 (i.e., when the piston 70 is at its highest axial position) within the hydraulic cylinder 68 (e.g., corresponding to the end of a stroke cycle), the pressure intensification module 78 also releases the pressure associated with the drilling mud from the piston end 86 of the hydraulic cylinder 68, thereby allowing the hydraulic cylinder 68, housing 80, and lower packer cup assembly 60 to move axially upward (i.e., against the flow of drilling mud being pumped down through the casing 66) with respect to the upper packer cup assembly 58, piston rod 72, and piston 70, as illustrated by arrow 90. At the same time, a drain port within the pressure intensification module 78 allows some of the drilling mud to flow through the pressure intensification module 78 to a location axially beneath the downhole tool hydraulic retriever 56, thereby at least partially filling the volume displaced by the upwardly moving downhole tool hydraulic retriever 56.

As such, the pressure intensification module 78 alternatingly diverts pressure associated with the drilling mud between the upper and lower packer cup assemblies 58, 60. The diverted pressure causes the upper and lower packer cup assemblies 58, 60 to grip the inner wall 64 of the casing 66 in an alternating manner at the same time the pressure intensification module 78 applies (and releases) alternating pressures against the piston end 86 of the hydraulic cylinder 68. As a result, the downhole tool hydraulic retriever 56 moves axially upward (i.e., against the flow of the drilling mud down through the casing 66). As such, the downhole tool hydraulic retriever 56 self-extracts through the casing 66 using the pressure of the drilling mud (i.e., against which the downhole tool hydraulic retriever 56 moves) as a motive force that is routed by the sequencing valves and hydraulic distribution lines of the pressure intensification module 78 to enable the upward movement. More specifically, for each stroke cycle of the piston 70 within the hydraulic cylinder 68, the alternating gripping of the upper and lower packer cup assemblies 58, 60 that is facilitated by the pressure intensification module 78 enables the downhole tool hydraulic retriever 56 to move axially upward by approximately the stroke length $L_{stroke}$ the piston 70 within the hydraulic cylinder 68. For example, ill certain embodiments, the stroke length $L_{stroke}$ may be approximately 20 feet.

Figure 3A:
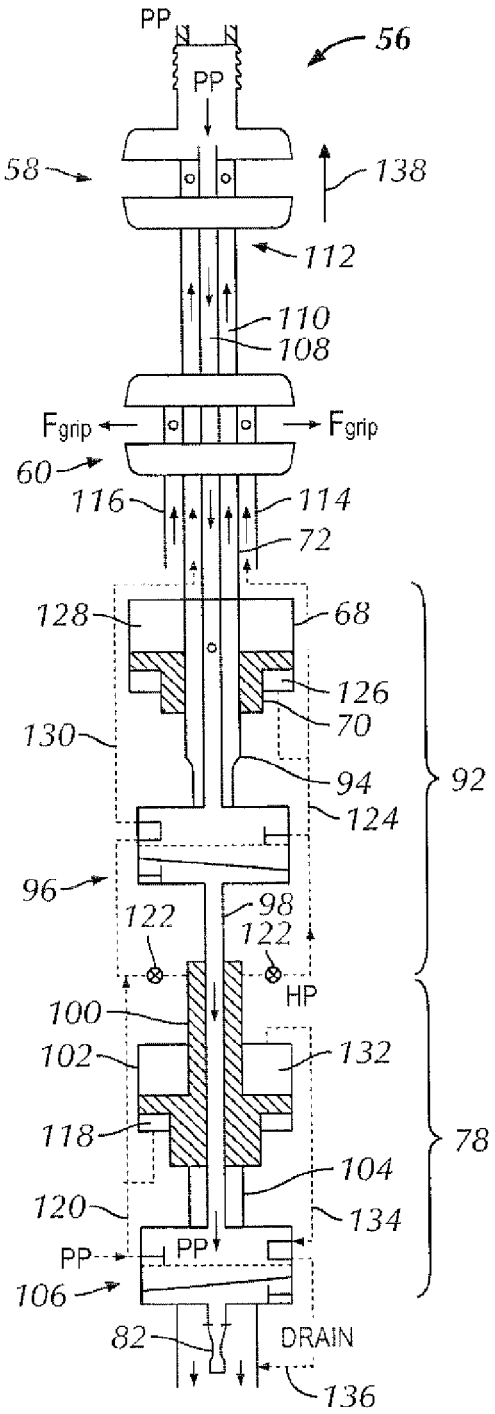
FIG. 3A is a schematic diagram of a downhole tool hydraulic retriever in a first mode (i.e., with drilling mud pressure being diverted to a lower packer cup assembly) in accordance with present techniques.
Figure 3B:
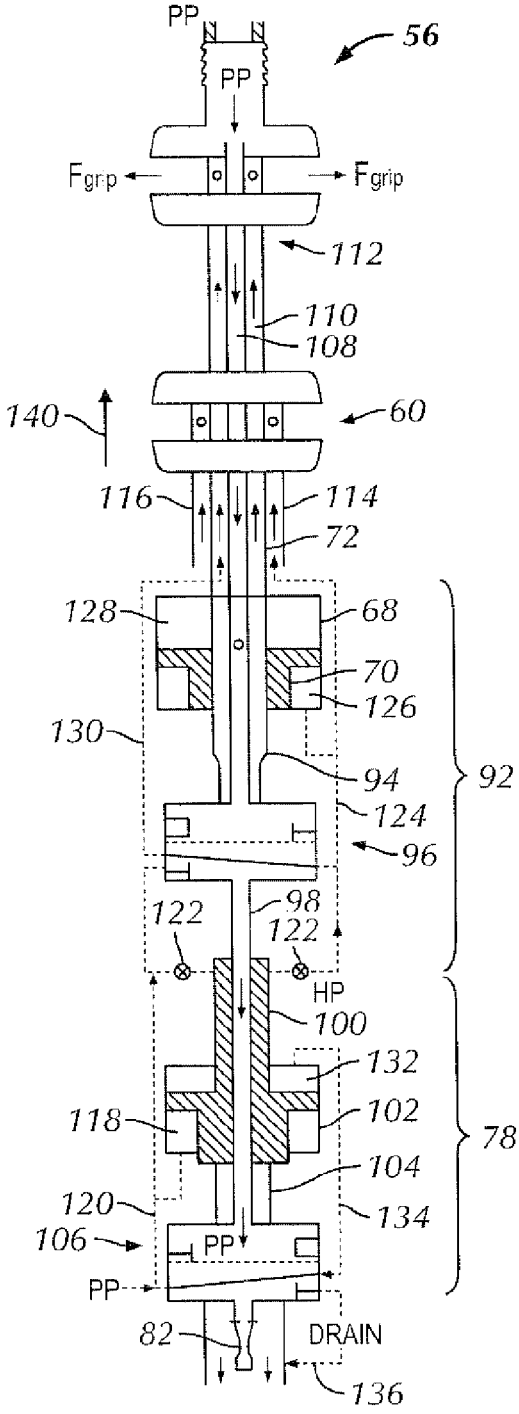
FIG. 3B is a schematic diagram of a downhole tool hydraulic retriever in a second mode (is., with drilling mud pressure being diverted to an upper packer cup assembly) in accordance with present techniques.

FIGS. 3A and 3B are schematic diagrams of a downhole tool hydraulic retriever 56 in accordance with present techniques. The downhole tool hydraulic retriever 56 illustrated in FIGS. 3A and 3B includes upper and lower packer cup assemblies 58, 60 that are axially disposed on a same axial side of many of the other components (e.g., the hydraulic cylinder 68, piston 70, pressure intensification module 78, and so forth) of the downhole tool hydraulic retriever 56, as opposed to being disposed on opposite axial sides of many of the other components of the downhole tool hydraulic retriever 56, such as illustrated in FIGS. 2A and 2B.

As also illustrated in FIGS. 3A and 3B, the hydraulic cylinder 68 and piston 70 are part of a stroking unit 92. Furthermore, the piston 70 illustrated in FIGS. 3A and 3B also includes another shaft portion 94 that extends from the piston 70 to a hydraulic routing body section 96 of the stroking unit 92. In addition, another shaft portion 98 extends from the hydraulic routing body section 96 of the stroking unit 92 to a piston 100 of the pressure intensification module 78, which is at least partially disposed within a hydraulic cylinder 102 of the pressure intensification module 78. Furthermore, another shaft portion 104 extends from the piston 100 of the pressure intensification module 78 to a hydraulic routing body section 106 of the pressure intensification module 78.

Although illustrated in FIGS. 3A and 3B as including a pressure intensification module 78 that is separate from the stroking unit 92, in certain embodiments, the pressure intensification module 78 and stroking unit 92 may form an integrated unit. For example, the hydraulic cylinders 68, 102 of the stroking unit 92 and the pressure intensification module 78 may be replaced by a single hydraulic cylinder. Similarly, the pistons 70, 100 of the stroking unit 92 and the pressure intensification module 78 may be replaced by a single piston. In addition, the hydraulic routing body sections 96, 106 of the stroking unit 92 and the pressure intensification module 78 may be replaced by a single hydraulic routing body section.

As illustrated in FIGS. 3A and 3B, an inner bore 108 extends through the piston rod 72 of the stroking unit 92, piston 70 of the stroking unit 92, shaft portion 94, shaft portion 98, piston 100 of the pressure intensification module 78, and shaft portion 104 of the downhole tool hydraulic retriever 56. In general, the drilling mud that is pumped down through the casing 66 with the downhole tool hydraulic retriever 56 is allowed to flow through the inner bore 108. However, when the connector 82 attaches to the drilling BHA 32 or another feature, the drilling mud is blocked from flowing through the pressure intensification module 78, thereby facilitating extraction of the drilling BHA 32 via the alternating axial motion of the upper and lower packer cup assemblies 58, 60, which is facilitated by the pressure intensification module 78. In addition, an outer bore 110 extends through the piston rod 72 to the hydraulic outing body section 96 of the stroking unit 92.

In addition, in the illustrated embodiment, the upper packer cup assembly 58 is attached to an upper axial end 112 of the piston rod 72 and, as such, translates axially in unison with the piston rod 72. Conversely, the lower packer cup assembly 60 is not attached to the piston rod 72. Rather, the lower packer cup assembly 60 is attached to an annular wall 114 that extends from the housing 80 (not shown) that surrounds the hydraulic cylinder 68. As such, the lower packer cup assembly 60 translates axially in unison with the hydraulic cylinder 68. The space between the annular wall 114 and the piston rod 72 forms an annular passage 116 between the lower packer cup assembly 60 and the hydraulic cylinder 68 that is generally concentric with the inner and outer bores 108, 110 through the piston rod 72.

FIG. 3A illustrates the downhole tool hydraulic retriever 56 in a first mode corresponding to the pistons 70, 100 being located within their respective hydraulic cylinders 68, 102 at axial locations relating to a beginning of a stroke, and FIG. 3B illustrates the downhole tool hydraulic retriever 56 in a second mode corresponding to the pistons 70, 100 being located within their respective hydraulic cylinders 68, 102 at axial locations relating to an end of a stroke. As illustrated in FIG. 3A, when the downhole tool hydraulic retriever 56 is in the first mode (i.e., at the beginning of a stroke cycle), pressure from the drilling mud is applied to a piston end 118 of the hydraulic cylinder 102 of the pressure intensification module 78 through a hydraulic line 120. In addition, this pressure is directed through one or more check valves 122 through another hydraulic line 124 to a piston end 126 of the hydraulic cylinder 68 of the stroking unit 92 and into the annular passage 116 that extends from the hydraulic cylinder 68 to the lower packer cup assembly 60.

As such, the pistons 70, 100 of the stroking unit 92 and the pressure intensification module 78 are biased axially upward by these pressures in the first mode. In addition, the pressure applied to the lower packer cup assembly 60 via the annular passage 116 causes the lower packer cup assembly 60 to apply a radially outward force $F_{grip}$ against the inner wall 64 of the casing 66 (not shown) within which the downhole tool hydraulic retriever 56 is disposed. Therefore, in the first mode, the lower packer cup assembly 60 and the hydraulic cylinders 68, 102 of the downhole tool hydraulic retriever 56 remain relatively axially fixed, while the rest of the components d the downhole tool hydraulic retriever 56 are biased axially upward, as illustrated by arrow 138.

At the same time, fluid from a cylinder end 128 of the hydraulic cylinder 68 of the stroking unit 92 is directed via another hydraulic line 130 through the hydraulic routing body section 96 of the stroking unit 92. In addition, fluid from a cylinder end 132 of the hydraulic cylinder 102 of the pressure intensification module 78 is directed via another hydraulic line 134 through the hydraulic routing body section 106 of the pressure intensification module 78 and out through a drain 136 into the casing 66 axially below the downhole tool hydraulic retriever 56. As such, the volume directly below the downhole tool hydraulic retriever 56 that is left vacated due to the axially upward movement of the downhole tool hydraulic retriever 56 is filled with the drilling mud that exits the downhole tool hydraulic retriever 56 via the drain 136.

Conversely, as illustrated in FIG. 3B, when the downhole tool hydraulic retriever 56 is in the second mode (i.e., at the end of a stroke cycle, pressure from the drilling mud is routed via the hydraulic line 134 to the cylinder end 132 of the hydraulic cylinder 102 of the pressure intensification module 78. In addition, this pressure is directed through hydraulic line 120, the one or more check valves 122, hydraulic line 124, hydraulic routing body section 96 of the stroking unit 92, and hydraulic line 130 to the cylinder end 128 of the hydraulic cylinder 68 of the stroking unit 92 and into the outer bore 110 of the piston rod 72 that extends to the upper packer cup assembly 58.

As such, the pistons 70, 100 of the stroking unit 92 and the pressure intensification module 78 are shifted to being biased axially downward by these pressures. In addition, the pressure applied to the upper packer cup assembly 58 via the outer bore 110 causes the upper packer cup assembly 58 to apply a radially outward force $F_{grip}$ against the inner wall 64 of the casing 66 within which the downhole tool hydraulic retriever 56 is disposed. Therefore, in the second mode, the lower packer cup assembly 60 and the hydraulic cylinders 68, 102 of the downhole tool hydraulic retriever 56 are biased axially upward, as illustrated by arrow 140, while the rest of the components of the downhole tool hydraulic retriever 56 remain relatively fixed.

Therefore, again, the upper and lower packer cup assemblies 58, 60 move upwardly through the casing 66 in an alternating manner, with one packer cup assembly 58, 60 gripping the inner wall 64 of the casing 66 during a first of two modes, and the other packer cup assembly 58, 60 gripping the inner wall 64 of the casing 66 during a second of two modes. During both modes, the pressure from the drilling mud being pumped down through the casing 66 provides the pressure for actuating the upper and lower packer cup assemblies 58, 60 in the alternating manner, as well as providing the overall upward pressure to motivate the downhole tool hydraulic retriever 56 upward through the casing 66 (i.e., against the flow of the drilling mud being pumped down through the casing 66). In particular, the pressure intensification module 78 alternatingly diverts pressure associated with the drilling mud that is blocked from flowing through the downhole tool hydraulic retriever 56 to the upper and lower packer cup assemblies 58, 60 as well as alternatingly applying (and releasing) pressure against the pistons 70, 100 of the stroking unit 92 and the pressure intensification module 78, respectively.

Figure 4:
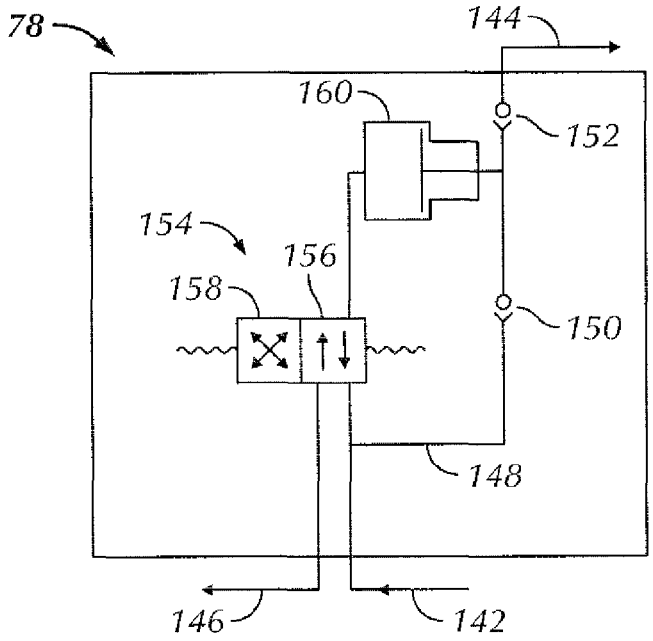
FIG. 4 is a schematic diagram of a pressure intensification module in accordance with present techniques.

The pressure intensification module 78 described above may be implemented in various ways. For example, FIG. 4 is a schematic diagram of a pressure intensification module 78 in accordance with present techniques. As illustrated in FIG. 4, the pressure intensification module 78 may include an inlet line 142 for receiving the flow of drilling mud (e.g., from the inner bore 108 of the downhole tool hydraulic retriever 56 illustrated in FIGS. 3A and 3R), an outlet line 144 that outputs pressure to the packer cup assemblies 58, 60 and the hydraulic cylinders 68, 102, and a drain line 146 for draining the drilling mud below the downhole tool hydraulic retriever 56. In the illustrated embodiment, the flow of drilling mud may be directed through a hydraulic distribution line 148 and a pair of check valves 150, 152 to the packer cup assemblies 58, 60 and the hydraulic cylinders 68, 102.

As illustrated, the pressure intensification module 78 also includes a valve assembly 154 that is configured to be toggled between first and second modes 156, 158. When the valve assembly 154 is actuated in the first mode 156, fluid from within a pressure intensification piston assembly 160 is routed through the hydraulic line 148 to the packer cup assemblies 58, 60 and the hydraulic cylinders 68, 102. However, when the valve assembly 154 is actuated in the second mode 158, fluid from within the pressure intensification piston assembly 160 is routed through the drain line 146. As such, during the first mode 156, pressure builds up in a given packer cup assembly 58, 60 and against a particular end (e.g., piston end or cylinder end) of an associated hydraulic cylinder 68, 102. Conversely, during the second mode 158, pressure is released from the given packer cup assembly 58, 60 and from the particular end (e.g., piston end or cylinder end) of the associated hydraulic cylinder 68, 102, while the drilling mud is also drained through the drain line 146. It will be understood that the components illustrated in FIG. 4 are related to either the upper packer cup assembly 58 or the lower packer cup assembly 60, and that similar components may also be used for the other packer cup assembly 58, 60.

Figure 5:
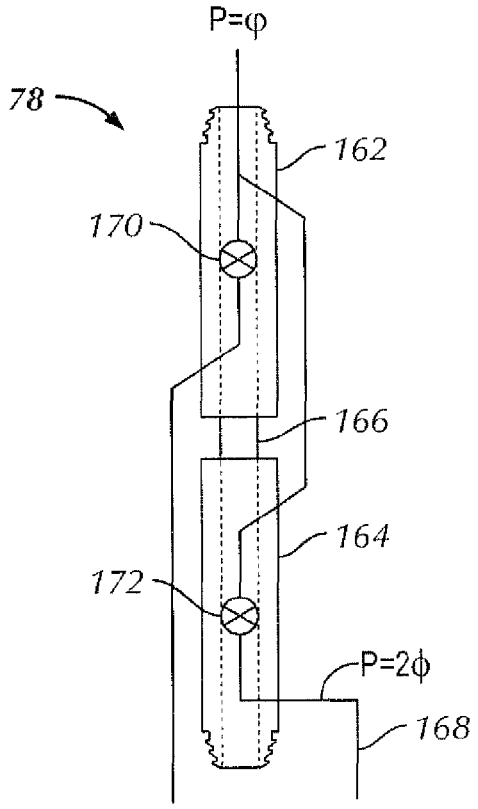
FIG. 5 is a schematic diagram of a motor-type pressure intensification module in accordance with present techniques.

FIG. 5 is a schematic diagram of a motor-type pressure intensification module 78 in accordance with present techniques. As illustrated in FIG. 5, the pressure intensification module 78 includes a larger hydraulic motor 162 and a smaller hydraulic motor 164, with the two hydraulic motors 162, 164 connected by a common shaft 166. For example, the larger hydraulic motor 162 may be a motor capable of displacing 250 gallons per revolution at approximately 500 pounds per square inch (psi) and the smaller hydraulic motor 164 may be a motor capable of displacing approximately 50 gallons per revolution at approximately 2500 psi. The larger hydraulic motor 162 drives the smaller hydraulic motor 164, thus creating a higher pressure differential between the two hydraulic motors 162, 164 than the difference in volume displacement. The illustrated pressure intensification module 78 also includes an input line 168 for controlling the sequencing of respective valves 170, 172 within the larger and smaller hydraulic motors 162, 164. By actuating the sequencing valves 170, 172 at specific times, appropriate pressure intensification may be created by the pressure intensification module 78 and directed to the packer cup assemblies 58, 60 and hydraulic cylinders 68, 102.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed:

1. A downhole tool hydraulic retriever, comprising:

a stroking unit comprising a hydraulic cylinder, a piston body at least partially disposed within the hydraulic cylinder, and a piston rod extending from the piston body, wherein the piston rod comprises an inner bore for enabling flow of drilling mud from an upper end of the downhole tool hydraulic retriever to a lower end of the downhole tool hydraulic retriever;

first and second pipe gripping mechanisms configured to translate axially with respect to each other;

a pressure intensification module comprising sequencing valves and hydraulic distribution lines; and a connection mechanism configured to connect to a bottom hole assembly, wherein the connection mechanism is configured to block the flow of drilling mud through the inner bore of the piston rod and to direct the flow of drilling mud through the pressure intensification module when the connection mechanism is connected to the bottom hole assembly;

wherein the pressure intensification module is configured to alternatingly direct pressure associated with the flow of drilling mud between the first and second pipe gripping mechanisms through the sequencing valves and hydraulic distribution lines of the pressure intensification module, such that the first and second pipe gripping mechanisms alternatingly apply an outward radial force.

2. The downhole tool hydraulic retriever of claim 1, wherein the pressure intensification module is configured to apply pressure associated with the flow of drilling mud through the pressure intensification module against a piston end of the hydraulic cylinder when the pressure associated with the flow of drilling mud through the pressure intensification module is diverted to the first pipe gripping mechanism.

3. The downhole tool hydraulic retriever of claim 2, wherein the second pipe gripping mechanism is configured to move axially upward through casing with respect to the first pipe gripping mechanism when the pressure is applied against the piston end of the hydraulic cylinder.

4. The downhole tool hydraulic retriever of claim 1, wherein the pressure intensification module is configured to release pressure associated with the flow of drilling mud through the pressure intensification module from a piston end of the hydraulic cylinder when the pressure associated with the flow of drilling mud through the pressure intensification module is diverted to the second pipe gripping mechanism.

5. The downhole tool hydraulic retriever of claim 4, wherein the first pipe gripping mechanism is configured to move axially upward through the casing with respect to the second pipe gripping mechanism when the pressure is released from the piston end of the hydraulic cylinder.

6. The downhole tool hydraulic retriever of claim 1, wherein the sequencing valves and hydraulic distribution lines of the pressure intensification module are configured to divert the pressure associated with the flow of drilling mud through the pressure intensification module to the first pipe gripping mechanism when the piston body is at a minimum axial stroke location with respect to the hydraulic cylinder, and the sequencing valves and hydraulic distribution lines of the pressure intensification module are configured to divert the pressure associated with the flow of drilling mud through the pressure intensification module to the second pipe gripping mechanism when the piston body is at a maximum axial stroke location with respect to the hydraulic cylinder.

7. The downhole tool hydraulic retriever of claim 1, wherein the connection mechanism is configured to activate a sequencing valve of the pressure intensification module the connection mechanism connects to the bottom hole assembly, thereby blocking the flow of drilling mud through the inner bore of the piston rod and forcing the flow of drilling mud through the pressure intensification module.

8. The downhole tool hydraulic retriever of claim 1, wherein the first and second pipe gripping mechanisms are axially disposed on opposite axial sides of the stroking unit when the downhole tool hydraulic retriever is disposed within the casing.

9. The downhole tool hydraulic retriever of claim 1, wherein the first and second pipe gripping mechanisms are axially disposed on the same axial side of the stroking unit when the downhole tool hydraulic retriever is disposed within the casing.

10. The downhole tool hydraulic retriever of claim 1, comprising a housing within which the stroking unit and the pressure intensification module are at least partially disposed.

11. A downhole tool hydraulic retriever, comprising:

a stroking unit comprising a hydraulic cylinder, a piston body at least partially disposed within the hydraulic cylinder, and a piston rod extending from the piston body;

first and second pipe gripping mechanisms configured to translate axially with respect to each other; and a pressure intensification module comprising sequencing valves and hydraulic distribution lines configured to divert pressure to the first pipe gripping mechanism when the piston body is at a beginning of a stroke within the hydraulic cylinder, and to divert pressure to the second pipe gripping mechanism when the piston body is at an end of the stroke within the hydraulic cylinder.

12. The downhole tool hydraulic retriever of claim 11, wherein the stroking unit comprises an inner bore that extends into the pressure intensification module, such that pressure can be created by the flow of drilling mud flowing through the inner bore of the stroking unit into the pressure intensification module.

13. The downhole tool hydraulic retriever of claim 12, wherein the pressure intensification module comprises a sequencing valve configured to block the flow of drilling mud through the pressure intensification module when the downhole tool hydraulic retriever connects to a bottom hole assembly.

14. The downhole tool hydraulic retriever of claim 11, wherein the first pipe gripping mechanism is configured to apply an outward radial force against an inner wall of casing within which the downhole hydraulic retriever is disposed as a result of the pressure diverted to the first pipe gripping mechanism when the piston body is at the beginning of the stroke within the hydraulic cylinder, and the second pipe gripping mechanism is configured to apply an outward radial force against the inner wall of casing within which the downhole hydraulic retriever is disposed as a result of the pressure diverted to the second pipe gripping mechanism when the piston body is at the end of the stroke within the hydraulic cylinder causes.

15. The downhole tool hydraulic retriever of claim 14, wherein the pressure intensification module is configured to apply the pressure against a piston end of the hydraulic cylinder when the piston body is at the beginning of the stroke within the hydraulic cylinder, and the pressure intensification module is configured to release the pressure from the piston end of the hydraulic cylinder when the piston body is at the end of the stroke within the hydraulic cylinder.

16. The downhole tool hydraulic retriever of claim 11, wherein the first pipe gripping mechanism is configured to move axially upward with respect to the second pipe gripping mechanism through an inner wall of casing within which the downhole tool hydraulic retriever is disposed while the piston body traverses from the beginning of the stroke within the hydraulic cylinder to the end of the stroke within the hydraulic cylinder, and the second pipe gripping mechanism is configured to move axially upward with respect to the first pipe gripping mechanism through the inner wall of casing while the piston body traverses from the end of the stroke within the hydraulic cylinder to the beginning of the stroke within the hydraulic cylinder.

17. The downhole tool hydraulic retriever of claim 11, wherein the first and second pipe gripping mechanisms are axially disposed on opposite axial sides of the stroking unit.

18. The downhole tool hydraulic retriever of claim 11, wherein the first and second pipe gripping mechanisms are axially disposed on the same axial side of the stroking unit.

19. A method, comprising:

pumping a drilling mud and a downhole tool hydraulic retriever down through casing, wherein the downhole tool hydraulic retriever is not coupled to surface equipment;

connecting the downhole tool hydraulic retriever with downhole equipment in the wellbore; and using pressure of the drilling mud to cause the downhole tool hydraulic retriever and the connected downhole equipment to travel upward through the casing against the flow of the drilling mud.

20. The method of claim 19, comprising using the pressure of the drilling mud to alternatingly activate a pair of pipe gripping mechanisms of the downhole tool hydraulic retriever, wherein the alternatingly activated pipe gripping mechanism applies an outward radial force against an inner wall of the casing, such that the load of the downhole equipment is supported by the downhole tool hydraulic retriever.

* * * * *